United States Patent [19]

Wallace

[11] 4,003,551

[45] Jan. 18, 1977

[54] WINCH-HOIST

[75] Inventor: Bernard E. Wallace, Exton, Pa.

[73] Assignee: B. E. Wallace Products Corporation, Malvern, Pa.

[22] Filed: Nov. 6, 1975

[21] Appl. No.: 629,262

Related U.S. Application Data

[63] Continuation of Ser. No. 453,919, March 22, 1974, abandoned.

[52] U.S. Cl. ..... 254/169; 254/164; 242/117; 24/135 A

[51] Int. Cl.[2] ..... B66D 1/00

[58] Field of Search ..... 254/164, 167, 161, 169, 254/150 R, 190 R; 74/523, 155; 242/117 R; 24/135 A, 135 N, 115 P

[56] References Cited

UNITED STATES PATENTS

| | | | |
|---|---|---|---|
| 2,364,471 | 12/1944 | Parker | 254/169 |
| 3,128,857 | 4/1964 | Walton | 242/117 |
| 3,150,861 | 9/1964 | Ahlbin | 242/117 |
| 3,648,978 | 3/1972 | Ratcliff | 254/167 |

*Primary Examiner*—Robert J. Spar
*Assistant Examiner*—Kenneth Noland
*Attorney, Agent, or Firm*—Synnestvedt & Lechner

[57] ABSTRACT

A portable winch-hoist comprises a main supporting frame, with an anchor hook, and carrying a ratchet-driven cable drum and an actuating frame, or lever, which may in practice be generally U-shaped and may span the main frame and which is pivoted for swinging movements about the axis of the cable drum. Pawls carried by the main frame and by the lever are selectively cooperable with the drum ratchet to rotate, to hold, and to release, the drum, so as to reel, and to control the unreeling of, cable carried by the drum, in response to pivotal swinging of the lever.

The cable is releasably retained on the drum, being wrapped thereon and passing through portions of the drum at two axially-spaced points, whereby sufficient turns of cable are retained on the drum to assure a capstan or snubbing effect, under all normal operating conditions, with an end portion of the cable arranged for set-screw securement to the drum, whereby cable replacement is simplified. The lever includes provision for attachment thereto of an operating handle, in any one of several positions, for facility and ease of operation, and to assure ample leverage under all conditions; and the handle has a safety link, bendable when the force applied to the handle exceeds a predetermined amount, and the handle also has within it a space adapted to house spare links. When the hoist is used with the cable looped or passing around a pulley of a pulley-block to form two lines, the cable end remote from the drum is releasably secured, by the cable-end-hook, to the main frame in a position which makes it possible to use a lighter construction for the main frame, for a given load capacity, and substantially reduces the minimum distance achievable between the anchor hook and the pulley-block-hook.

18 Claims, 15 Drawing Figures

WINCH-HOIST

The present application is a continuation of my application Ser. No. 453,919 filed Mar. 22, 1974, and abandoned as of the filing date of the present application.

Claims on certain features of the handle apparatus H, for actuating the winch-hoist, as described and illustrated herein, were required to be divided from said application 453,919, and such claims have been presented in Applicant's copending application, Ser. No. 604,963, filed Aug. 15, 1975.

BACKGROUND AND SUMMARY OF THE INVENTION

My invention relates to winch-hoists, and especially to portable winch-hoists, and particularly to that type of hoist in which a main frame, generally box-shaped in form, has a pair of frame arms between which is rotatably mounted a ratchet-driven drum upon which the lifting cable is reeled, and a U-shaped operating lever has arms which span the main frame, being pivoted thereto for swinging movements about the drum axis. Pawls carried by the main frame and lever are selectively cooperable with the drum ratchet to rotate and control the drum when the lever is pivotally actuated. Features of such a winch-hoist are disclosed in U.S. Pat. No. 2,633,328, which issued on Mar. 31, 1953.

The patented hoist, just referred to, has a number of commercially proven advantages, particularly in the construction of, and mode of cooperation between, the ratchet and the pawls. However, it has developed that further significant improvements can be made. For example, in apparatus common in the prior art, it has been necessary to secure the cable to the drum by the use of a slug of metal swaged to an end of the cable and secured to the drum in a recess provided in the drum surface. In such prior apparatus, when the cable required replacement, it has been necessary to cut the cable and in some cases to resort to the use of special swaging tools. Complications involved in this procedure have made it difficult to make cable replacements in the field. Usually it has been easier to return the hoist to a factory facility for replacement.

Prior art apparatus has also suffered from the disadvantage that, when it was desired to double the cable by the use of a pulley-block, which requires coupling the hook-end of the cable to the main frame, the "hook-to-hook" distance, that is the distance from the anchor hook to the load hook on the pulley-block, was substantial, and this correspondingly reduced the available working space beneath the load hook. Also, stresses generated at the point of securement of the doubled cable, which point was heretofore at or adjacent to the lower end of the main frame, have necessitated use of a main frame of a heavier configuration throughout its length, than would otherwise be required for a given load capacity. In addition, to protect user, hoist and load, it has been common to design the manually operable handle, which drives the pawl lever, in such a way as to permit bending of the handle when it was subjected to torque in excess of a predetermined limit. Such bending usually rendered the handle unusable. A further disadvantage was that there has been very limited freedom for variably associating the handle with the lever, or no freedom (in the case of integral lever and handle), frequently resulting in having to operate the winch at a short effective lever arm, when the winch was used in tightly confined positions, and/or making it impossible to have a working stroke in the most advantageous direction.

It is the general objective of this invention to overcome all of the aforesaid problems by provision of improved winch-hoist apparatus in which, although the cable is very securely wound and fastened on the drum under all operating conditions, yet field replacement of the cable is a very simple matter, the double-rigged "hook-to-hook" distance is reduced, frame weight can be minimized, and the handle includes safety and convenience features and operational advantages not previously available. In achievement of these general objectives, I have provided a hoist in which the cable is releasably retained on the drum in novel fashion, being snubbed thereon capstan-fashion, by passing a plurality of turns around the drum and through apertures in the drum structure at two axially-spaced-apart points, it being engaged adjacent at least one of said points by fastening means which prevent the snubbing turns from coming loose.

I have been able to minimize the anchor-to-load distance, when double-rigged, while at the same time making possible the reduction of the weight of the hoist, by providing improved means for attaching the doubled cable to the frame, which means is disposed in an upper location with respect to the frame, e.g., near the anchor hook.

The invention also provides a handle which is not only unique and improved per se, but also cooperable with the hoist at any of four (or more, if desired) angularly related positions, thereby permitting optimization of the operating position and of the 'pull angle' without a reduction in leverage; thus avoiding the need for excess effort by the operator. In particular accordance with the present invention, the handle inlcudes a bendable safety link which protects user, load and handle assembly, in the event of serious overloading. Should overloading be encountered, it is only necessary to replace the relatively inexpensive safety link, rather than a complete handle assembly.

The construction is such as to make it very easy to shift the operating position of the handle on the lever, and also very simple to remove and replace the bendable link. It is also a feature, that the handle apparatus of my invention incorporates storage space for spare safety links.

BRIEF DESCRIPTION OF THE DRAWINGS:

In the accompanying drawings:

FIGS. 1-D and 1-S are comparative fragmentary views, generally similar to FIG. 1; but FIG. 1-S illustrating a different rigging of the hoist, i.e., a single-line rigging; while FIG. 1-D shows the double-line rigging of FIG. 1, but with the pulley-block pulled up close to the winch frame structure.

Figure 1:
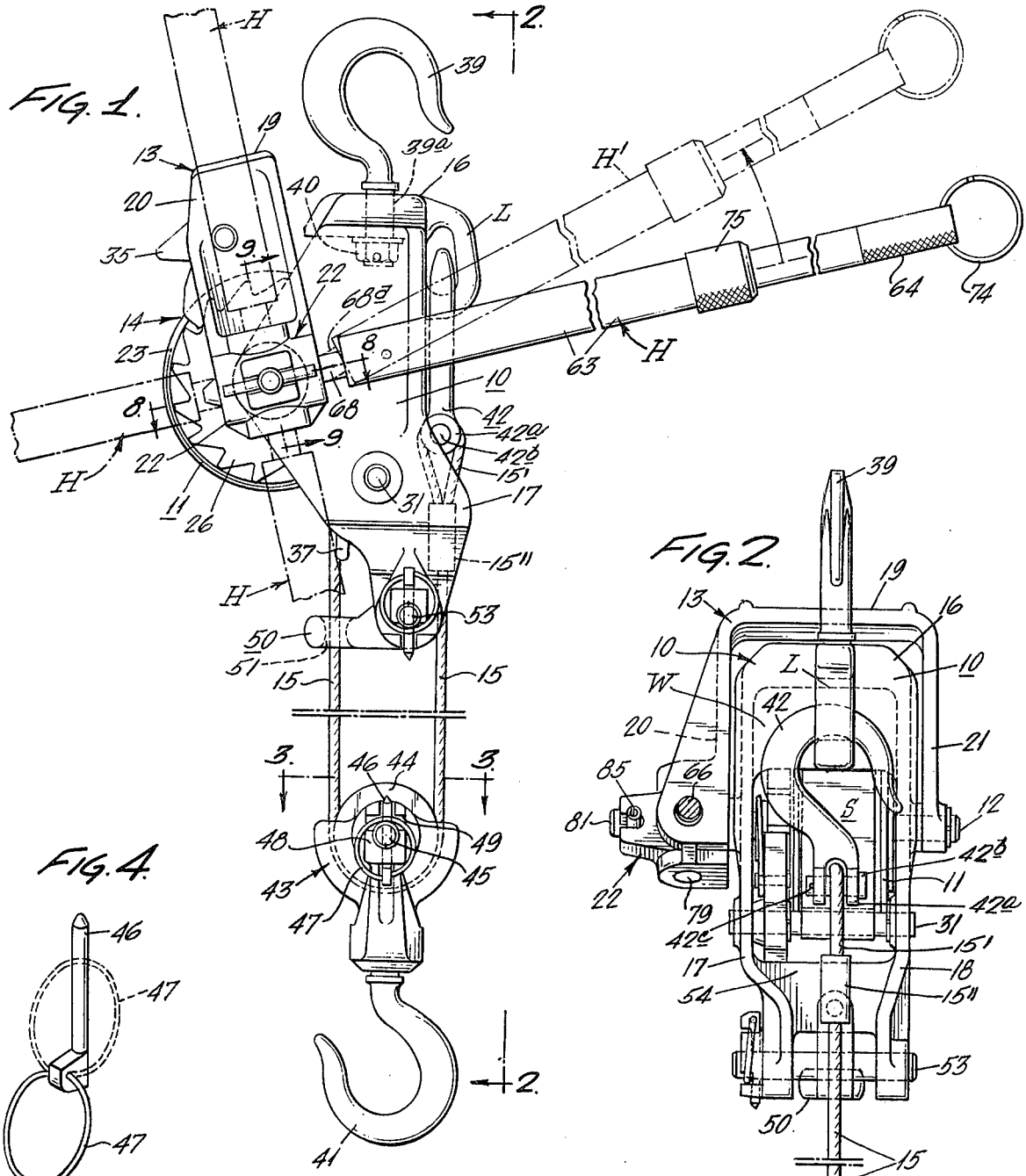
FIG. 1 is a side elevational view of a portable winch-hoist embodying the present invention, illustrating the hoist in one condition of rigging, and showing the operating handle in several positions.

DETAILED DESCRIPTION OF THE PREFERRED EMBODIMENT:

With initial reference to FIGS. 1, 2, 5 and 6, there is shown a winch-hoist comprising: a main frame 10, a drum 11, rotatably mounted on said main frame through the agency of an axle 12; lever means 13, pivoted on said axle 12 for swinging movements about the rotational axis of said drum 11; and ratchet and pawl means indicated generally by the reference numeral 14 (see also FIG. 7) and to which further, more detailed, reference will be made in what follows. The ratchet and pawl means are responsive, selectively to swinging movements of the lever, to rotate said drum for reeling of cable 15 thereon, and, alternatively, for controlled opposite rotation of the drum for unreeling of cable therefrom, under the pull of the load.

The main frame 10 is of generally box-shape (see FIGS. 2 and 5), comprising an upper cross-member or anchor-portion 16, a pair of spaced vertical walls or arms 17 and 18, and a bottom cross-brace 54. Generally midway of the length of the walls or arms 17, 18, they are provided with confronting apertures which serve to journal the axle 12, which may be secured in the arms in any convenient manner. The lever 13 is of U-shape, comprising a cross-member portion 19 and a pair of spaced arms 20 and 21. The arms 20 and 21 are spaced a distance sufficient to span the width of the main 10, as defined by its arms 17 and 18, and the latter arms are received between the arms 20 and 21 of the lever. As clearly appears in the drawings, the axle 12, on which the rotatable drum 11 is mounted, extends through the arms 17 and 18 of the box-shaped frame a distance sufficient to provide for pivotal mounting of the arms 20 and 21 of the swingable lever 13 outside of the frame.

Figure 2:
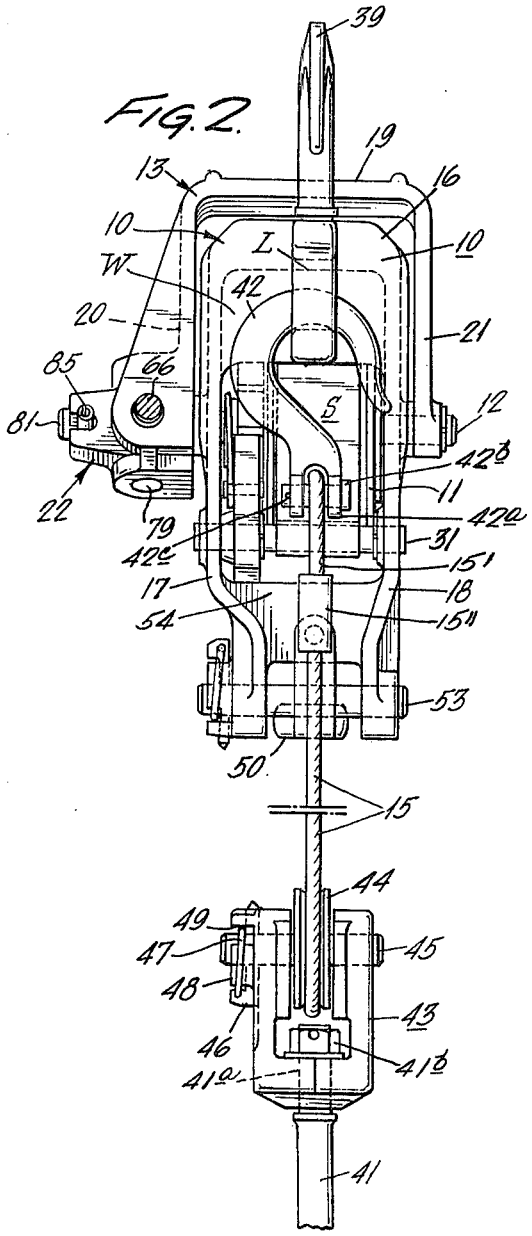
FIG. 2 is an elevational view looking in the direction of the line 2—2 applied to FIG. 1.
Figures 5, 6, 7:
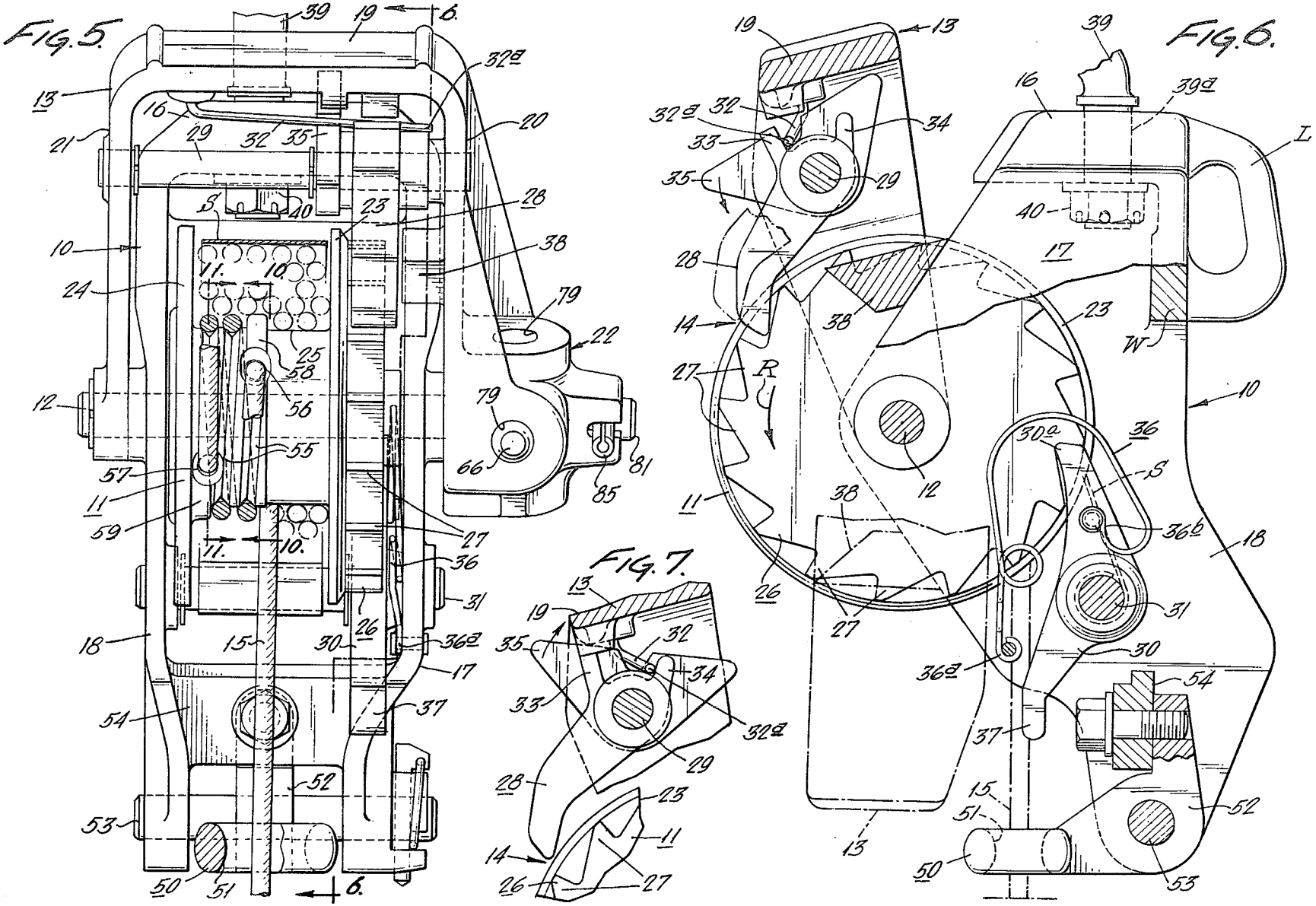
FIG. 5 is an elevational view illustrating, on a larger scale, the apparatus shown in FIG. 1, as it would appear when viewed from the left of FIG. 1.
FIG. 6 is a sectional view taken as indicated by the line 6—6 of FIG. 5.
FIG. 7 is a fragmentary showing of certain pawl mechanism embodied in the apparatus illustrated in FIGS. 5 and 6.

It should be noted that, as shown in FIGS. 2 and 5, the upper portion of frame 10 is of considerably heavier cross-section than the lower portion thereof. The significance of this will be clear from what follows.

Figure 9:
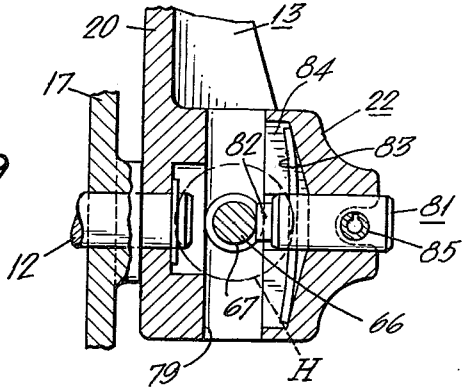
FIGS. 8 and 9 are sectional views taken as indicated, respectively, by the lines 8—8 and 9—9 of FIG. 1, but on a larger scale, illustrating parts of the handle mounting means on the lever, for easy change of handle operating positions.

The arm 20 of the lever is provided at its free end with an enlarged boss 22, within which is received the operating handle H in a manner to be described in what follows. As shown in FIG. 9, the axle 12 extends within the boss 22 a distance just sufficient to journal the arm 20, thereby affording room for mounting the handle structure to be described.

As appears to good advantage in FIGS. 5 and 6, the drum 11 comprises a pair of spaced flanges 23 and 24 and a hub or barrel portion 25. The flange 23 carries a ratchet wheel 26, preferably formed integrally with flange 23 and carrying a plurality of ratchet teeth 27 (see particularly FIG. 6). When it is desired to reel cable on the drum, the drum must be driven in the direction indicated by the arrow R in FIGS. 6, 10 and 11, and such drive is effected by cooperation between the teeth 27 of ratchet wheel 26 and a pair of pawls, one of which (28) is pivotally secured to the lever 13 by a pin or axle 29, and the other of which (30) is pivotally secured between the arms 17 and 18 of frame 10, by a pin or axle 31. Preferably, the pawls are made of a sintered powdered metal, oil-impregnated, so as to be self-lubricating on their axles. The ratchet and pawl drive is, in principle, the same as the apparatus disclosed in said U.S. Pat. No. 2,633,328. While reference may be had to the disclosure of said patent, for detailed understanding of the functioning of the ratchet and pawl mechanism, such detailed description is not required herein, since this apparatus is not, per se, a part of the present invention. For the purposes of the present disclosure, the following description is sufficient.

Lever-carried pawl 28 can be biased either into or out of engagement with the teeth 27 of ratchet wheel 26, by a spring 32 which has one end retained in the cross-member 19 of lever 13 and its opposite end, **32*a* disposed between a pair of spaced ears 33 and 34 which project from pawl 28 (FIGS. 5, 6 and 7). A cocking lever 35 is pivotally mounted on rod 29. When this lever occupies the position shown in FIG. 6, the pawl 28 is biased toward its position in contact with the teeth 27. When the cocking lever occupies the position shown in FIG. 7, the spring portion 32*a* biases the pawl 28 out of contact with the teeth 27, as shown. A looped spring 36 has one end 36*a* secured to arm 17 of the main frame, and its other end 36*b* secured to the main frame pawl 30. This latter spring normally serves to bias the pawl 30, which is a holding pawl, toward contact with the teeth 27, although the pawl 30 is movable out of contact with the teeth, either by pressure exerted against a finger release 37 or by cooperative contact between pawl 28 and spring 36** in accordance with the principle described in the above-referenced patent.

In summary, when it is desired to reel cable upon the drum barrel 25, the lever 13 is swung downwardly from the position shown in full lines in FIG. 6, toward the lower position shown in broken lines in said figure. The limiting positions of the lever are established by contact of a lever-carried stop 38 against the upper portion of main frame arm 17, as shown in FIG. 6, or by contact of said stop against the lower portion of said arm, as shown in chain-dotted lines in the figure. In response to such swinging movement of lever 13, the pawl 28, being engaged with one of the teeth 27, carries said tooth downwardly and rotates the drum an increment established by the angular distance between the upper and lower positions of lever 13, or any intermediate amount measured by tooth-by-tooth steps, if desired. The frame-carried pawl 30, which is also biased toward the teeth, serves as a holding pawl, the point **30*a* of this pawl engaging the teeth 27** successively as they pass by, thus preventing retrograde movement of the cable under the influence of the supported load, as will be understood.

When it is desired to permit reverse rotation of the drum to lower the load, the cocking lever 35 is moved to the position shown in FIG. 7, in which position the pawl 28 is held out ot contact with the teeth 27 of ratchet wheel 26, during downward movement of the lever 13. As the lever 13 approaches the lower position illustrated in FIG. 6, and as is clearly shown in the referenced patent, pawl 28 comes into contact with spring 36 and the said spring is acted upon by the pawl to bias pawl 30 away from the teeth 27. At the same time, the lever-carried pawl 28 is being moved, by contact with spring 36, back into its ratchet-engaging position, against the opposing bias exerted by spring 32. This cooperative movement, which will only take place when the cocking lever 35 is in the position shown in FIG. 7, permits the ratchet wheel to move in the unreeling direction, under the influence of the load, an angular distance defined by one tooth, under the control of the lever.

In short, the ratchet and pawl means described is responsive to swinging movements of the lever 13 to rotate the drum, and thereby reel any cable associated with the drum, and to allow controlled unreeling thereof under the influence of the load.

If a considerable length of cable is to be unreeled, under no-load conditions, it may be more convenient to hold the pawl 30 out of contact with the teeth, by exerting pressure against finger release 37, rather than repeating the tooth-by-tooth sequence described above.

As shown in FIGS. 1 and 2, the cross-member or anchor-portion 16 of frame 10 is provided with means for anchoring the hoist to fixed structure. In the illustrated embodiment this means takes the form of anchor hook 39 rotatably mounted within the anchor-portion 16, through the agency of a shank 39*a* and a castellated nut 40, secured in known manner.

When the cable 15 is looped or doubled back, for amplifying the pulling or lifting capacity of the winch-hoist (which is the rigging arrangement shown in FIGS. 1 and 2), two hooks are normally employed, in addition to the anchor hook 39. These two-hooks are shown at 41 and 42 in FIGS. 1 and 2. In this doubled-back arrangement of the cable 15, the end (which may for convenience be termed the free end) of the cable is formed with an end loop 15', held by the clamp 15''; and this end loop 15' is secured to the hook 42, by means of a clevis 42*a* formed on said hook, and a securing pin 42*b*, which may be held by a cotter pin or the like 42*c*. Hook 42 is secured (in the rigging of FIGS. 1 and 2) to a loop, or eye, L, on frame 10 at a location which provides special advantages, as hereinafter described, (with reference also to FIG. 1-D).

The bight of the line thus formed by the two runs of the cable 15, as shown, carries the hook 41, by means of the pulley-block now to be described.

Figure 3:
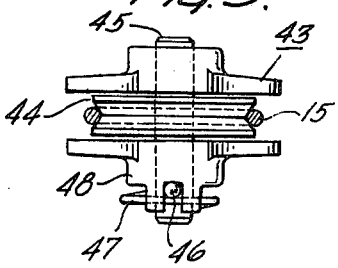
FIG. 3 is a view taken as indicated by the line 3—3 of FIG. 1.

The load-bearing hook 41 is pivotally secured by shank 41*a* and castellated nut 41*b*, to the pulley-block or yoke 43, which is bifurcated, as shown in FIG. 3, to receive a pulley 44 about which the cable 15 is looped, in this illustrated rigging position. An axle 45 releasably secures the yoke assembly, and the axle may be withdrawn from the yoke to disassociate the assembly from the cable.

Figure 4:
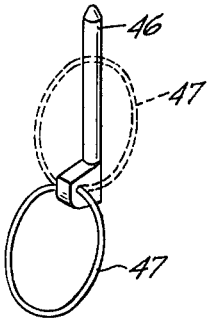
FIG. 4 is a perspective view of a securing device, known per se, conveniently used in a novel manner in the sub-assembly shown in FIG. 3.

Retaining means (FIGS 3 and 4) comprise a pin 46 and a looped spring 47. In accordance with known practice, the pin is insertable within a cross aperture provided in axle 45, in the manner shown in FIG. 3, after which, swinging of the loop, from the lower position illustrated in FIG. 4, to the upper position (see particularly FIG. 1), resiliently engages the spring loop 47 with a boss 48. The latter is formed as a part of the yoke and is relieved, at 49 (FIG. 1), to permit entrance of the spring loop 47. When it is desired to remove this load-carrying assembly from association with the cable and utilize the winch-hoist in the rigging condition which employs a single run of cable, with the hook 42 serving directly to support the load, it is a simple matter to remove the securing pin 46, withdraw the axle 45, and remove the yoke 43 and pulley 44 from the cable. Then, as shown in FIG. 1-S, the hook 42 is uncoupled from the loop L, and the end portion of the cable hangs straight down from the drum, and carries the load directly by means of hook 42.

Cable guide means is provided at the lower end of frame arms 17 and 18, as is illustrated in FIGS. 1 and 2. This guide means comprises a loop of metal 50, apertured at 51, and being of generally bell-crank form, as appears most clearly in FIG. 6. One arm of the bell crank provides the apertured loop 50, while the other arm 52 is journaled to the arms 17 and 18 by an axle rod 53, and said arm 52 is also bolted to a web 54 which forms part of the structure of main frame 10 (FIG. 5), extending between the frame arms.

In fabricating apparatus in accordance with this invention, the frame, lever, and certain other parts have been cast of aluminum alloy. Good results are obtained if the alloy is of the kind specified in the trade as number 356-T-6. As will be appreciated, the principles of the invention are applicable to winch-hoists of various sizes. Hoist capacity may range up to several thousand pounds, a capacity of 2,000 pounds being representative of a small portable winch-hoist. In any particular embodiment, the maximum capacity of the apparatus is, of course, achieved when the equipment is rigged to use multiple runs of cable, for example the doubled cable arrangement, with pulley-block as best seen in FIGS. 1 to 3, and FIG. 1-D.

In especial accordance with the present invention, the winch-hoist includes novel means for releasably retaining the cable on the drum 11, by snubbing the cable on said drum. For example, the first few turns of cable on the hub of the drum are so held thereon as to provide a very firm snubbing or gripping effect and cannot be inadvertently loosened in normal use; and yet the cable can be easily removed when desired, and can be replaced, without the need for any unusual type of cable or cable fittings or any special tools. As will be understood, this arrangement, which will now be described in detail, obviates former difficulties involved in removing and replacing worn or broken cable, and permits ready replacement of the cable in the field.

Figure 11:
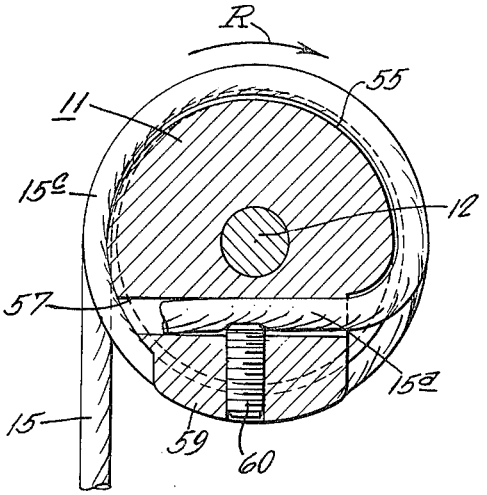
FIGS. 10 and 11 are sectional views taken, respectively, as indicated by the lines 10—10 and 11—11 of FIG. 5, but on a larger scale, illustrating the configuration of the drum hub and the mode of applying the two or more snubbing turns of the cable thereon, and the means for preventing the loosening of said turns.
Figure 10:
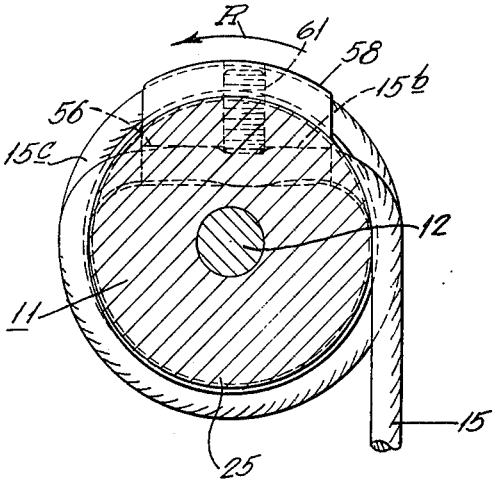
Figure 10:
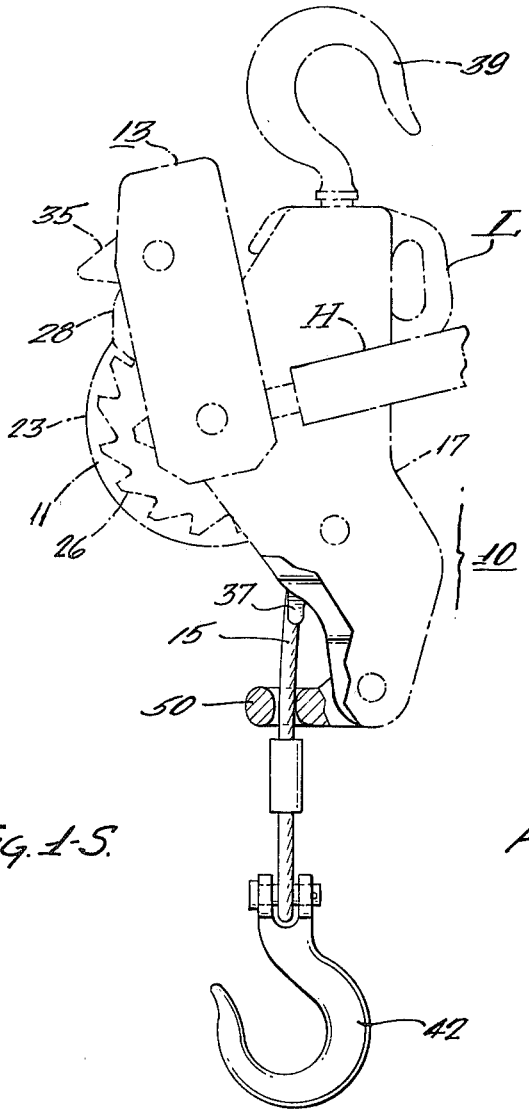
Figure 10:
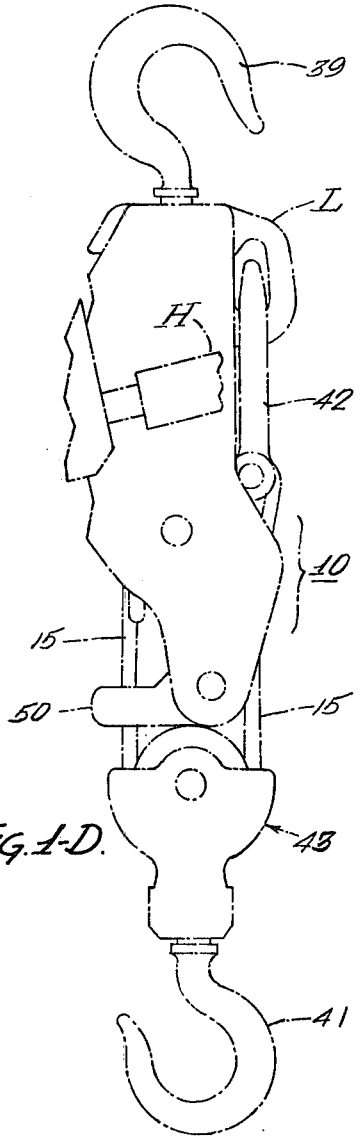

Now making particular reference to FIGS. 5, 10 and 11, it will be seen that the hub or barrel portion 25 of the drum is provided with a pair of passages to receive certain portions of the cable; and the surface of the drum, in the region of said passages, is desirably provided with helical grooves. The grooves are shown at 55, in FIG 5, and the grooving is preferably V-shaped in cross section. Such shaping of the grooves assists in the tight gripping of the cable on the drum and increases the snubbing thereof on the drum, during wrapping of the first few turns, as the cable is applied. The cable-receiving passages, one of which appears at 56 in FIG. 10, and the other at 57 in FIG. 11, are spaced axially along the drum in the region of drum grooving, and each passage extends from the drum surface through the drum in a plane which is transverse to the drum axis, as is clearly seen from FIGS. 10 and 11. Passage 56 extends through the drum in a mid-region of the axial length of the drum, as seen in FIG. 5. Passage 57 extends through the drum in adjacency to the lefthand flange 24, as the drum appears in FIG. 5.

As explained in more detail below, portions of the cable are disposed within these passages; and a cable holding device is associated with at least one of the passages, and preferably such cable holding devices are utilized at both passages, as will appear hereinafter.

When applying a cable to the drum, the free-end portion of a cable, that is, a portion which would equal several turns around the hub 25 of the drum 11, is threaded through the passage 56 (from right to left as seen in Fig. 10). This portion of the cable is then wrapped around the hub (clockwise as viewed in FIG. 10 -- counterclockwise as viewed in FIG. 11), being laid helically in the grooving 55 (seen in those Figures and in FIG. 5) to form the snubbing turns on the drum; and the ultimate end 15*a* of this cable is then pushed into the bore or passage 57 (see FIGS. 5 and 11).

As shown most clearly in FIGS. 10 and 11 a pair of arcuately-curved cable supporting ribs or lands 58, 59, are provided, each being adjacent one of the passages 56, 57. Each land projects above and extends circumferentially around a portion of the hub surface, the projection being about equal to the cable thickness. Land 58 projects above the general hub surface in the region of passage 56, and land 59 projects above said surface in the region of passage 57. The ribs or lands position and support the next layer of cable, as wound on later, in areas where portions of the first few turns extend into passages 56 and 57 of the hub. They also have the advantage of strengthening the structure in the region of the set-screws 60 and 61 now to be described.

The cable holding or securement means referred to above comprises a pair of set-screws or the like, 60 and 61, each of which is received within a recess formed in a corresponding one of said lands. The screw elements are threaded within the drum hub structure, preferably including the land projections, and enter the passages 57 and 56 to engage the cable therein in the manner plainly shown in FIGS. 11 and 10.

It should be understood that the screw devices 60 and 61 are not depended upon to carry the working load on the cable. Rather, they function as follows: After the snubbing portion of the cable has been passed through the bore 56, wrapped a few times around the hub (in the illustrated case, about 2 ½ turns), and the end 15*a* inserted into bore 57; then screw 60 is turned in tight against the cable-end 15*a*, even to the point of being partially embedded in the cable, as shown in FIG. 11. This can hold the cable-end 15*a* as against a pull of perhaps 100, 200or 300pounds. The cable (toward the right, at 15 in FIG. 10) is then subjected to a substantial pull — even as much as several thousand pounds — depending upon cable strength, and the intended load capacity of the winch-hoist, so as to tighten the several turns 15*c* into a snubbing or capstan-like grip on the hub. The screw 61 may then be tightened in the cable portion 15*b* (as seen in FIG. 10) to keep the snubbing portion 15*c* against unintentional loosening. Normally, screw 61 is not turned down as tightly as screw 60 (as is evident from a comparison of FIGS. 10 and 11), because, if a very heavy load is imposed on the cable in actual service, the portion 15*b* may have to have limited freedom to slide or stretch, under the load, so that the snubbing turns will be correspondingly pulled tighter. Screw 61, in some cases, may even be dispensed with, but it does tend to avoid unwanted loosening of the snubbing turns 15*c* when load is taken off the winch-hoist.

As explained above, the illustrated arrangement has the particular advantage that field replacement of the cable is a very simple matter. With either the original cable, or with a replacement cable, it will now be understood that by turning the drum 11 in the direction of arrow R, the second course of the cable will wind across the first course and be laid smoothly thereon, with the aid of the land areas 58 and 59; and the subsequent layers will wind smoothly back and forth. Although shown only fragmentarily in the drawing, at S in FIGS. 5 and 6, the hoist preferably includes a flexible cable shield which contacts the cable and promotes even wrapping on the drum. It also prevents any tendency for the cable to "throw-off" the drum.

As will be evident from the foregoing description, it is a further feature of the invention that, when it is desired to use the hoist with a doubled cable, as appears in FIGS. 1, 2, and 1-D, the free end of the cable, carrying the hook 42, is releasably coupled to the main frame 10 at an upper location of said main frame, rather than beneath the latter, as has been common in the prior art. To accommodate such releasable securement of the cable hook 42, the main frame 10 is provided with the above-mentioned structure L which is looped to form an eye within which the hook 42 is received. The loop structure L is formed upon and projects from the frame cross-portion 16, and from a relatively heavy web W which extends between the frame arms 17 and 18 (FIGS. 2, 5 and 6). Such location of the loop L makes it possible to lighten the hoist to a considerable degree, since frame portions extending below the cross-portion and the web W may be of lesser cross section than the upper frame portions.

The way in which this configuration and construction minimizes the hook-to-hook distance will appear, strikingly, from a comparison of FIGS. 1-D and 1-S. In the double-rigged arrangement (illustrated in detail in FIGS. 1 to 4), though it employs two load hooks, 41 and 42, with hook 41 forming part of a load-carrying pulley-block assembly, the cable can be pulled up, by winding on the drum 11, until the distance from the anchor-hook 39 to the load-hook 41 (as seen in FIG. 1-D) is so shortened as to be quite comparable to the distance from hook 39 to hook 42 in the single-rigged operation (seen in FIG. 1-S), due chiefly to the securing of hook 42 to the loop or eye L adjacent the top of the frame in the double-rigged operation.

The novel handle H will now be described, as will the structure of the arm of the pawl-carried lever, which accommodates said handle in any of a plurality of different positions — four being employed in the illustrated embodiment. The handle comprises two telescopically-arranged tubes 63 and 64, as appears in FIGS. 1, 12 and 13. The tube 63, which is to be coupled to the lever 13, has nested within it a sleeve 65 (FIG. 12) which is of a size to receive a bendable link 66 which projects axially of the handle for insertion within the enlarged end or boss 22 of lever arm 20. This link may be of steel and is designed to bend in the event of an overload imposed on the handle.

Although it could be made of uniform diameter, with the desired bendability, the link 66 desirably has different diameters at different zones, as will now appear. For example, it is advantageous to make the link of a general diameter large enough to just provide for the maximum bending strength for which it might be called upon in a unit intended for a certain maximum load, but which might be variably adapted for different maximum loads, and for this purpose a section or zone of it may be turned down to a smaller diameter.

Furthermore, for ready adaptablity to being quickly mounted on, and disconnected from, the several different sockets or passages 79 in the lever boss or hub 22, by means of a convenient snap fastener, it is desirable to provide a zone of reduced diameter to engage such a fastener.

In the illustrated embodiment, the link is configured to have two annular zones of reduced cross section. These annular zones are shown in the drawings at 67 and 68, which are thus spaced by larger land areas 69 and 70. When the handle is in use, as will be described in what follows, annular zone 67 and land areas 69 and 67, lie within the arm of the lever means, while a short portion of zone 68 projects from the handle tube 63 and is subject to bending under excessive applied force. Zone 68 may be of one diameter, in its exposed part and in the part housed in tube 63 (as shown); or those two parts may be of different diameters — for example by turning down the exposed part. Also, the housed part may directly fit the inside of tube 63, or may be fitted to an adapter sleeve (as shown). As will be plain from what follows, the exposed portion of the zone 68 bends in response to overloads applied to the handle, thereby protecting the winch, the user, the load, and the handle.

Figure 12:
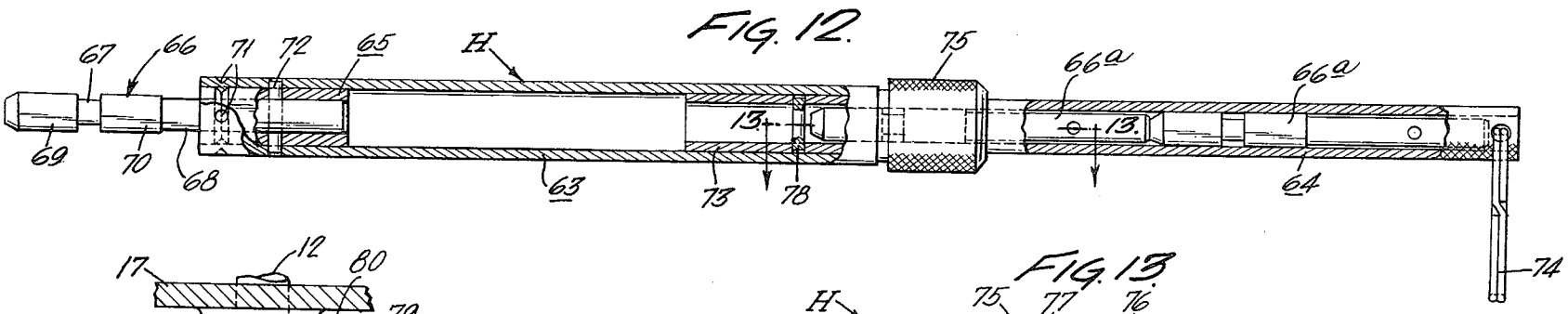
FIG. 12 is a sectional view of the operating handle.
Figure 13:
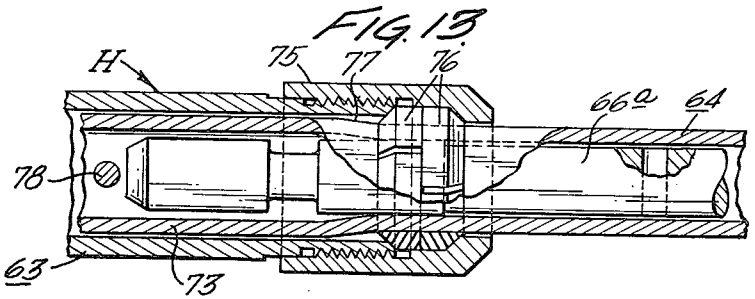
FIG. 13 is a sectional view, on an enlarged scale, taken as indicated by the line 13—13 of FIG. 12.

The sleeve 65 may be staked within the tube, as shown in FIG. 12 at 71, and/or a cross pin 72 may be placed radially through apertures provided in tube 63 and sleeve 65 to retain the safety link 66 in position. The outboard tube 64 is of smaller diameter than the tube 63, and is received within the latter tube. Outboard tube 64 has an end 73 (FIG. 13) sized to fit snugly within the inboard tube 63 and, if these two tubes be fully telescoped, the inboard end of portion 73 of tube 64 will bear against the sleeve 65. For clarity in illustration, the two tubes are shown in their positions of substantial relative extension, to form a handle of maximum length, having a ring 74 at one end thereof. The two tubes may be held in any selected position of extension by rotation of an externally knurled and internally threaded ferrule 75, which cooperates with a pair of tapered and split lock washers 76 (FIG. 13) to secure the two tubes against relative movement. The righthand portion of tube 64 is of a diameter somewhat smaller than the diameter at 73, the smaller diameter being of size which just passes through the ferrule 75. The enlarged portion 73 and the tapered portion 77, which lies between the larger and smaller diameter portions of tube 64, cannot pass through the split washers 76, or through the outer end of ferrule 75, so that the tube 64 will not be accidentally disengaged, either when adjusting the handle length, or during operation of the winch. When adjusted, the telescopic handle portions are held in the desired position when the ferrule 75 is tightened; and the handle is ready to use.

The outboard tube 64 is sized to receive one or more (in this case two), safety links (see 66*a*) to be kept available as spares. A cross pin 78 (FIGS. 12 and 13) prevents escape of the spare links through that end of the tube 64 which is nested within the tube 63. The ring 74 passes through the tube 64 and is of split type, being readily removable to afford access to the spare links.

Figure 8:
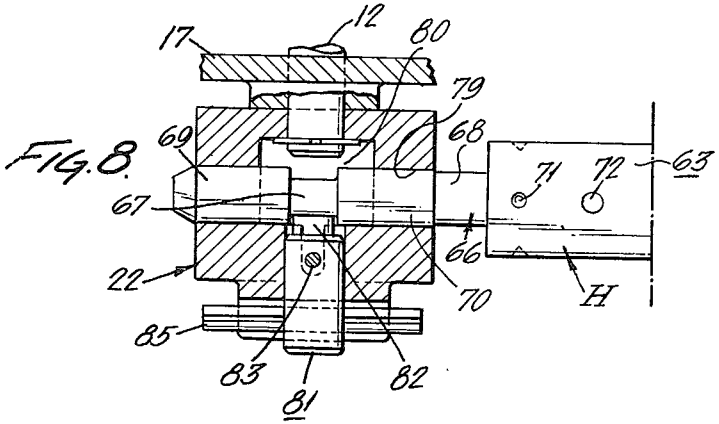

Turning now to the novel manner in which the handle II can be associated with the lever 13, and with particular reference to FIGS. 1, 8, and 9, it will be observed that the handle may occupy any one of four different positions, depending upon the convenience of the user, and possible environmental obstructions. One position of the handle appears in full lines in FIG. 1, and three other positions, each separated by 90°, appear in broken lines. The handle is also shown in broken lines at a position indicated by the reference numeral II′, this being a position which the handle might occupy after having been subjected to a force in excess of a predetermined limit. If the handle were subjected to such a force, the exposed annular area 68 would bend as is indicated at 68*a* in FIG. 1. Those portions of the bendable link which are received within the boss 22 of arm 20 of the lever 13 would be supported by the said structure and would not bend significantly.

To accommodate association of the handle at any one of a number of desired locations within the lever 13, arm 20 of the lever is provided with a plurality of (in this instance four) angularly related passages formed in coplanar relation in the enlarged boss 22. All of these pasages are identical, and they have been identified by the reference character 79, appearing in FIGS. 2, 5, 8 and 9. In this embodiment, these passages are disposed radially, at 90° angles, about a region of interesection 80, located within the arm of the lever. Detent means 81 projects into this region from a side of the boss 22 (see particularly FIGS. 8 and 9), and enters the region of intersection between the several passages 79. This detent means, which takes the form of a pin, is resiliently held in position in which its nose 82 is engageable within the annular recess 67 of the bendable link 66. Conveniently, the resilient holding means comprises a flexible spring rod 83 which is captive within a slot 84 (FIG. 9) provided in the boss 22. When it is desired to associate the handle with the lever, or to disassociate it therefrom, the pin 81 is withdrawn slightly, against the resilience of spring 83, permitting its nose 82 to be withdrawn from the annular region 67 of link 66. A cross rod 85, which passes through pin 81, may be grasped to withdraw the pin. The described handle arrangement which may be associated with the lever in any one of several different positions makes it possible to optimize the "pull-angle" of the handle.

In summary, apparatus in accordance with the present invention provides an improved winch-hoist in which field replacement of the cable is a simple matter, without the need for cable with special fittings, or special tools, and the hoist may be made lighter, for any given capacity. In addition, these advantages are achieved in a structure which minimizes the hook-to-hook distance, and thereby maximizes the lifting distance and/or the space for a load to be handled.

The novel telescopic handle may be adjusted as to length, for maximum usable leverage, shortening for tight spots or for quick rewind. The novel safety links, and the special manner in which they are associated with the handle and the pawl-carrying lever, provide advantages both as to facility of changing links and as to ease of altering the angular position of handle mounting.

It should be noted that where the operating handle II is shown in full lines in FIG. 1, and in broken lines at H in that Figure (indicating the result of exerting an excessive force on the lever); and also with respect to the description as to the most convenient or the most effective position for mounting and/or operating the handle; it should be understood that this is only illustrative. In some, if not most, instances where the winch-hoist is anchored by hook 39 from an overhead structure, the normally desired position of greatest advantage to the operator would be a position where the handle is pulled straight down, when the maximum load is being lifted or lowered.

While a stranded steel cable is typically used in, or associated with, the winch-hoist, it should be understood that the term "cable" is used in a broad sense, to refer to any flexible member suitable for employment in the environment here involved, except where a more specific meaning may be definitely required by the context.

Also, the terms "top" of the winch-hoist, "bottom" of the same, "upper " and "lower" and "right" and "left", and similar terms, are used, for convenience, with reference to the illustrations in the drawings; but it will be understood that this mechanism may be used in an upright position, or in a horizontal position, or even upside down; whereever lifting or lowering or pulling is required; so that the above and similar terms are used simply in an illustrative and not a limitative sense.

In conclusion, it is intended that the entire disclosure be considered as illustrative, and as limited only by the claims, and that the latter be construed as broadly as permitted by the prior art.

I claim:

1. Winch-hoist apparatus, comprising: a frame having anchor means adjacent one end thereof; a drum rotably mounted on said frame; generally U-shaped lever means having a pair of arms between which said drum and frame are received, said arms being pivotally connected to said frame for swinging movements of said lever means about the rotational axis of said drum; ratchet and pawl mechanism responsive to swinging movements of said lever means to effect rotation of said drum in one direction, or, alternately, to permit controlled rotation of said drum in the opposite direction when under load; a cable; means coupling one end portion of the cable to the drum to accommodate reeling and unreeling of the cable under the control of such swinging movements of said lever means, and with freedom for release and replacement of the cable in the field, said coupling means including a pair of cable-containing tubular passages, spaced axially along the drum, each passage extending from the drum surface into the drum in a direction transverse the drum axis, and at least one passage extending completely through said drum, the construction and arrangement being such that the cable has spaced portions disposed within said passages, the portion in said one passage extending completely through said drum, and a snubbing portion, intermediate said spaced portions, wrapped generally helically about said drum to snub and thus anchor the cable thereon, and the construction further including cable securement means associated with at least one of said passages and bearing against the side of cable disposed within that passage; a load-carrying assembly disposed to depend from a loop of the cable when the apparatus is in use under a doubled, basic, rigging condition; a load-bearing means adjacent an end of the cable and adapted to provide for such looping of said cable and consequent multiplication of the lifting force; and support means to which said load-bearing means may be releasably secured, said support means being carried by said frame in the region of that end of said frame which cooperates with said anchor means, whereby the distance between said anchor means and the specified load-carrying assembly is minimized when the apparatus is in use under said doubled rigging condition.

2. Winch-hoist apparatus, comprising: a frame having anchor means adjacent one end thereof; a drum rotatably mounted on said frame; generally U-shaped lever means having a pair of arms between which said drum and frame are received, said arms being pivotally connected to said frame for swinging movements of said lever means about the rotational axis of said drum; ratchet and pawl mechanism responsive to swinging movements of said lever means to effect rotation of said drum in one direction, or, alternatively, to permit controlled rotation of said drum in the opposite direction when under load; a cable; means coupling one end portion of the cable to the drum to accommodate reeling and unreeling of the cable under the control of such swinging movements of said lever means, and with freedom for release and replacement of the cable in the field, said coupling means including a pair of cable-containing tublar passages, spaced axially along the drum, each passage extending from the drum surface into the drum in a direction transverse the drum axis, and at least one passage extending completely through said drum, the construction and arrangement being such that the cable has spaced portions disposed within said passages, the portion in said one passage extending completely through said drum, and a snubbing portion, intermediate said spaced portions, wrapped generally helically about said drum to snub and thus anchor the cable thereon, the drum, in the region of cable coupling, being provided with helical grooving which is generally V-shaped in cross-section and within which grooving said cable is disposed; a load-carrying assembly disposed to depend from a loop of the cable when the apparatus is in use under a doubled, basic, rigging condition; a load-bearing means adjacent an end of the cable and adapted to provide for looping of said cable and consequent multiplication of the lifting force; and support means to which said load-bearing means may be releasably secured, said support means being carried by said frame in the region of that end of said frame which cooperates with said anchor means, whereby the distance between said anchor means and the specified load-carrying assembly is minimized when the apparatus is in use under said doubled rigging condition.

3. Apparatus according to claim 1, and further charcterized in that said securement means comprises at least one screw element threadedly received within the drum structure in position to clamp cable received within said one passage.

4. Winch-hoist apparatus, comprising: an elongated frame having anchor means adjacent one end thereof; a cable-carrying drum rotatably mounted on said frame with its axis spaced-away from said end of said frame; generally U-shaped lever means having a pair of arms between which said drum is received, said arms being pivotally connected to said frame, and extending laterally from one side of the frame, for swinging movements of said lever means about the rotational axis of said drum; ratchet and pawl mechanism responsive to swinging movements of said lever means to effect incremental rotation of said drum in one direction or, alternatively, to permit controlled incremental rotation of said drum in the opposite direction when under load; said drum having means for attachment of a snubbing end portion of a cable, the major portion of the cable being subject to reeling and unreeling with respect to said drum; load-bearing means adjacent the other end of the cable when the apparatus is in use under at least one normal, basic, rigging condition; a support with which said last means is alternatively cooperative, so as to provide for looping of said cable and consequent multiplication of the lifting force, said support being located at and secured to a side of said frame opposite to said one side, in a position for releasable securement of said load-bearing means to said frame in the region of that end of said frame adjacent to said anchor means, a handle for swinging said lever means about the mentioned axis, to actuate said ratchet and pawl mechanism; means defining a plurality of angularly related passages provided in an arm of said lever means and accommodating selective attachment of said handle at any one of several positions spaced angularly with respect to the axis of said drum; and resiliently-releasable means for securing the handle in any selected one of its positions.

5. In a winch-hoist of the type including a supporting frame, a drum rotatably mounted on said frame, lever means pivotably connected to said frame for swinging movements about the rotational axis of said drum, and ratchet and pawl mechanism responsive to swinging movements of said lever means to rotate said drum and alternatively to control opposite rotation thereof, whereby to reel and unreel cable associated with the drum, the improvements which comprise: means for anchoring one end section of a cable to the drum, with freedom for release and replacement of such cable, said last means including a pair of tubular passages for receiving cable, said passages being spaced axially along the drum and each passage extending from the drum surface into the drum in a direction transverse the drum axis; the construction and arrangement being such that an end section of a cable anchored to the drum has spaced portions received within said passages and another anchoring portion, intermediate said spaced portions, wrapped generally helically about said drum to provide a capstan or snubbing effect, and said drum, in the region of such cable wrap, being provided with cable holding means adapted to retain the anchoring portion of the cable as against unintentional loosening or dislodgment, said cable holding means comprising a pair of screw elements each threadedly received within the drum wall in a position to impinge upon and clamp cable received within a corresponding one of said passages.

6. A winch-hoist, comprising: an elongated frame having a major central axis and anchor means adjacent one end of said frame and generally on said major axis; a cable-carrying drum rotatably mounted on said frame with its rotational axis spaced-away from said one end of said frame, and disposed laterally of said major axis; generally U-shaped lever means having a pair of arms between which said drum is received, said arms being pivotally connected to said frame, and extending laterally away from one side of said frame, for swinging movements of said lever means about the rotational axis of said drum; ratchet and pawl mechanism responsive to swinging movements of said lever means to effect incremental rotation of said drum in one direction or, alternatively, to permit controlled incremental rotation of said drum in the opposite direction when under load; said drum having means for attachment of a snubbing end portion of a cable, the major portion of the cable being subject to reeling and unreeling with respect to said drum; load-bearing means adjacent the other end of the cable when the apparatus is in use under at least one normal, basic, rigging condition; and a support with which said last means is alternatively cooperative so as to provide for looping of the cable and consequent multiplication of the lifting force, the looped cable extending from said drum closely along one side of said major axis and then returning closely along the other side of said major axis toward said one end of said frame, said support being located at and secured to a side of said frame opposite to said one side, in a position for releasable securement of said load-bearing means to said frame in the region of that end of said frame immediately adjacent to said anchor means, and above the cable-supporting surface of said drum.

7. Winch-hoist apparatus, comprising: a frame having anchor means adjacent one end thereof; a drum rotatably mounted on said frame; generally U-shaped lever means having a pair of arms between which said drum and frame are received, said arms being pivotally connected to said frame for swinging movements of said lever means about the rotational axis of said drum; ratchet and pawl mechanism responsive to swinging movements of said lever means to effect rotation of said drum in one direction, or, alernatively, to permit controlled rotation of said drum in the opposite direction when under load; a cable having one end portion coupled to said drum, and said drum being adapted to accommodate reeling and unreeling of cable under the control of such swinging movements of said lever means; a load-carrying assembly disposed to depend from a loop of the cable when the apparatus is in use under a doubled, basic, rigging condition; and a load-bearing means adjacent an end of the cable and adapted to provide for such looping of said cable and consequent multiplication of the lifting force; support means to which said load-bearing means may be releasably secured, said support means being carried by said frame in the region of that end of said frame which cooperates with said anchor means, whereby the distance between anchor means and the specified load-carrying assembly may be minimized; and further characterized by the inclusion of: means coupling the first-mentioned end portion of the cable to the drum, with freedom for release and replacement of the cable in the field, including a pair of cable-containing passages, spaced axially along the drum, and each passage extending from the drum surface into the drum in a direction transverse the drum axis; the construction and arrangement being such that the cable has spaced portions disposed within said passages and a snubbing portion, intermediate said spaced portions, wrapped generally helically about said drum to snub and thus anchor the cable thereon; and further including: structure comprising a pair of arcuately-curved, cable-positioning lands, each projecting above and extending circumferentially around a portion of the drum wall, one land being adjacent one of said passages, and the other land being adjacent the other of said passages.

8. Winch-hoist apparatus according to claim 7, and further characterized in that said cable-securement means comprises a pair of screw elements each projecting through a corresponding one of said lands and threaded within the drum structure in position to enter one of said passages and clamp the cable therein.

9. A winch-hoist, comprising a generally box-shaped frame having a cross-portion adapted to cooperate with anchor means, and a pair of spaced arms, a drum mounted between said arms for rotation about an axle carried by confronting portions of said arms, generally U-shaped lever means having a pair of spaced arms between which the arms of said frame are received, the arms of said lever means being mounted upon the drum axle for swinging movements thereabout, ratchet and pawl mechanism responsive to swinging movements of said lever means to actuate said drum in one direction of rotation and to control it in an opposite direction of rotation, so as to provide for reeling and unreeling of cable carried thereby, and handle and socket structure providing for swinging of said lever means to actuate said ratchet and pawl means, said structure comprising: a plurality of elongate passages formed in coplanar relation in a free-end portion of one arm of said lever means, and disposed radially about a region of intersection within said arm; detent means carried by said arm, normally projecting into said region in a direction transverse the plane of said passages, and resiliently displaceable therefrom; and handle means having a projecting portion snugly receivable within any selected one of said passages, after displacement of said detent means from said region, said detent means engaging said projecting portion of the inserted handle, and releasably retaining said portion within the selected passage, and said handle projecting-portion comprising a rod of reduced cross-section in at least one portion of its length and lying within said arm of said lever means, when the handle projecting-portion is inserted within a selected passage, and occupying said region to provide a seat for said detent means.

10. In a winch-hoist in accordance with claim 9, the further features that the handle has a portion lying outside of and adjacent said arm, when the handle is inserted, and that the material of which said portion is made and the cross-sectional area thereof are so chosen, that said portion serves as a protecting link which is bendable in response to application to said handle of force in excess of a predetermined limit.

11. Apparatus in accordance with claim 6, in which said load-bearing means comprises a hook member, and said support comprises structure adjacent the anchor end of the frame forming an aperture for receiving said hook member.

12. Apparatus in accordance with claim 11, in which said frame is of elongate, generally box-shaped form having a cross-member which is secured to said anchor means, the said member and the portions of the said frame in the region thereof being of heavier cross-section than lower portions of the frame.

13. Apparatus in accordance with claim 12, in which the said structure with its aperture is configured as an eye projecting outwardly from said frame cross-member.

14. In a winch-hoist of the type including a supporting frame, a drum rotatably mounted on said frame, lever means pivotably connected to said frame for swinging movements about the rotational axis of said drum, and ratchet and pawl mechanism responsive to swinging movements of said lever means to rotate said drum and alternatively to control opposite rotation thereof, whereby to reel and unreel cable associated with the drum, the improvements which comprise: means for anchoring one end section of a cable to the drum, with freedom for release and replacement of such cable, said last means including a pair of passages for receiving cable, said passages being spaced axially along the drum and each passage extending from the drum surface into the drum in a direction transverse the drum axis; the construction and arrangement being such that an end section of a cable anchored to the drum is passed through one of said passages leaving a portion of said section within said passage, and an intermediate anchoring portion of said section is wrapped generally helically about said drum to provide a capstan or snubbing effect, and the final end portion of said section is inserted in the other of said passages.

15. In a winch-hoist according to claim 14, the further characterization that the drum, in the region of such cable wrap, is provided with cable holding means adapted to retain the anchoring portion of the cable as against unintentional loosening or dislodgment.

16. In a winch-hoist according to claim 14, the further features that: one of said cable-receiving passages is adjacent one end of said drum; the other of said cable-receiving passages lies in a mid-region of the axial length of said drum; and at least said other passage extends completely through said drum, to accommodate passage of cable through the drum.

17. A winch-hoist according to claim 14, together with a releasable clamping device adapted to hold said final end portion of the cable.

18. A winch-hoist according to claim 14 including a device adapted to secure said final end portion of the cable in one of said passages, a device to secure said portion left in the other of said passages, and helical grooving, V-shaped in cross-section, on said drum in the region of said passages, said V-shaped grooving capable of imposing substantial friction upon said end portion of the cable when the cable is under tension, and said securing devices capable of maintaining a portion of said friction when the cable is not under tension.

* * * * *